US012515857B2

(12) United States Patent
Lin et al.

(10) Patent No.: US 12,515,857 B2
(45) Date of Patent: Jan. 6, 2026

(54) CUP LID AND CONTAINER USING THE CUP LID

(71) Applicant: XIAMEN CITY SPARK TECH. CO., LTD., Fujian (CN)

(72) Inventors: De Quan Lin, Fujian (CN); Yun Zhang, Fujian (CN); Yanmei Liang, Fujian (CN); Ling Wang, Fujian (CN); Biyuan Que, Fujian (CN)

(73) Assignee: XIAMEN CITY SPARK TECH. CO., LTD., Fujian (CN)

( * ) Notice: Subject to any disclaimer, the term of this patent is extended or adjusted under 35 U.S.C. 154(b) by 91 days.

(21) Appl. No.: 18/604,448

(22) Filed: Mar. 13, 2024

(65) Prior Publication Data

US 2024/0228135 A1 Jul. 11, 2024

(30) Foreign Application Priority Data

Sep. 25, 2023 (CN) ..... 202311241793.1
Dec. 29, 2023 (CN) ..... 202323662193.0

(51) Int. Cl.

| | |
|---|---|
| ***B65D 47/26*** | (2006.01) |
| ***A47G 19/22*** | (2006.01) |
| ***B65D 47/32*** | (2006.01) |
| ***B65D 51/16*** | (2006.01) |
| ***B65D 51/18*** | (2006.01) |

(52) U.S. Cl.

CPC ..... *B65D 51/18* (2013.01); *B65D 47/265* (2013.01); *B65D 47/32* (2013.01); *B65D 2251/0025* (2013.01); *B65D 2251/0081* (2013.01)

(58) Field of Classification Search

CPC .... B65D 51/18; B65D 47/261; B65D 47/265; B65D 47/266; B65D 47/32; B65D 2251/0025; B65D 2251/0081; B65D 43/02; B65D 47/06; B65D 51/16; B65D 2543/00046; A47G 19/2272; A47G 23/16

USPC ..... 220/254.8, 253

See application file for complete search history.

(56) References Cited

U.S. PATENT DOCUMENTS 3,100,589 A * 8/1963 Love, Jr. ..... B65D 47/265 222/548
3,342,385 A * 9/1967 Knight ..... B65D 47/261 222/548
3,357,605 A * 12/1967 Chadfield ..... B65D 47/265 222/548
4,613,063 A * 9/1986 Wright ..... B65D 55/02 222/548
5,058,778 A * 10/1991 Weinstein ..... B65D 83/00 222/548

(Continued)

*Primary Examiner* — Gideon R Weinerth
(74) *Attorney, Agent, or Firm* — Birchwood IP

(57) ABSTRACT

A cup lid that facilitates convenient operation by allowing effort saving opening of a water passing hole by using only one hand, wherein the cup lid has a main lid and an auxiliary lid; an upper surface of the main lid has the water passing hole and an air vent; the auxiliary lid is rotatably mounted on the upper surface of the main lid, and being axially limited with respect to the main lid. Rotation of the auxiliary lid will cause a water passing port disposed thereon to open or close the water passing hole; the auxiliary lid also has an air guide slot in which the air vent can slide therein when the auxiliary lid rotates, and the air guide slot is in communication with an external environment. A container using the cup lid is also provided.

11 Claims, 13 Drawing Sheets

(56) References Cited

U.S. PATENT DOCUMENTS

| | | | | | |
|---|---|---|---|---|---|
| 5,064,086 | A * | 11/1991 | McEntee | G01N 13/00 | 220/253 |
| 5,356,035 | A * | 10/1994 | Shlopak | B65D 47/265 | 222/548 |
| 5,449,085 | A * | 9/1995 | Brun, Jr. | B65D 47/265 | 222/548 |
| 6,216,903 | B1 * | 4/2001 | Hirose | A47G 19/2272 | 220/254.1 |
| 8,393,487 | B1 * | 3/2013 | Pillers | B65D 47/265 | 220/717 |
| 11,213,146 | B1 * | 1/2022 | Sletten | B65D 47/261 | |
| D944,083 | S * | 2/2022 | Boggs | D7/392.1 | |
| 11,246,434 | B2 * | 2/2022 | Siegenthaler | B65D 47/265 | |
| 2013/0062347 | A1 * | 3/2013 | Webster | G01F 11/46 | 220/253 |
| 2015/0014322 | A1 * | 1/2015 | Kim | B65D 51/1672 | 220/373 |
| 2015/0076151 | A1 * | 3/2015 | Knipe | A47G 19/2272 | 220/254.1 |
| 2015/0251818 | A1 * | 9/2015 | Strachan | B65D 43/18 | 220/254.8 |
| 2019/0185225 | A1 * | 6/2019 | Savenok | A47J 31/00 | |
| 2019/0315532 | A1 * | 10/2019 | Boggs | B65D 43/0225 | |
| 2019/0352059 | A1 * | 11/2019 | Mutch | A47J 41/0022 | |
| 2019/0352061 | A1 * | 11/2019 | Diener | B65D 47/265 | |
| 2021/0177173 | A1 * | 6/2021 | Siegenthaler | A47G 19/2272 | |
| 2021/0267392 | A1 * | 9/2021 | Rechsteiner | B65D 51/1633 | |
| 2023/0271757 | A1 * | 8/2023 | Lewandowski | B65D 51/18 | 220/259.4 |
| 2024/0150090 | A1 * | 5/2024 | Adams | B65D 47/265 | |
| 2024/0158141 | A1 * | 5/2024 | Chen | B65D 47/265 | |
| 2024/0228135 | A1 * | 7/2024 | Lin | B65D 51/18 | |
| 2025/0296747 | A1 * | 9/2025 | Low | B65D 53/04 | |

* cited by examiner

CUP LID AND CONTAINER USING THE CUP LID

BACKGROUND OF THE INVENTION

The present invention relates to the technical field of cup lids, in particular to a cup lid and a container using the cup lid.

Usually, a cup lid is separately provided from the cup. The cup lid is usually opened and closed with respect to the cup by for example, tight fitting between the cup and a sealing ring on a circumferential surface of the cup lid, or by threaded connection between the cup and the cup lid. Opening and closing of the cup lid as such can only be achieved by two hands, and can be particularly inappropriate in situations that may only allow one-hand operation such as during car driving and during exercising. Furthermore, shaking and vibration are common in the situations described above, and given that the cup lip is in a completely opened state after being opened, water in a cup may easily spilled out from the opened cup wetting the users and the surroundings and hence causing inconvenience.

Therefore, a push button type cup lid is provided in the market. Particularly, a movable cover pivoted to the cup lid can be pushed to achieve opening and closing of the cup lid, so that users can access the water inside the cup from a smaller through hole. However, water in contact with the movable cover will also splash around when the movable cover is pressed to eject from a closed state to an opened state, and since a spring is required to open the movable cover, it can be difficult to open the lid after the spring is aged. Besides, opening and closing of the cup lid as described so far intend to achieve a sealing effect between the cup lid and the cup, so when the cup is filled with hot water, and when the hot water is cooled after a long period time, it becomes difficult to open the cup lid because of a difference in air pressure, and it is particularly difficult for people who is not physically strong enough to open such cup lid.

BRIEF SUMMARY OF THE INVENTION

In view of the aforesaid disadvantages in the prior art in which it is inconvenient to use the cup lid, it is an object of the present invention to provide a cup lid and a container using the cup lid, wherein the cup lid can be quickly opened without much effort by one hand in order to drink water from the container.

To attain the object of the present invention, the present invention provides the following technical solutions:

A cup lid, comprising a main lid body and an auxiliary lid body; the main lid body is configured to removably seal an opening of a container; an upper surface of the main lid body is provided with a water passing hole and an air vent; the auxiliary lid body is rotatably disposed on the upper surface of the main lid body and being axially limited with respect to the main lid body; the auxiliary lid body is provided with a water passing port; when the auxiliary lid body rotates to a position where the water passing port at least partially aligns with the water passing hole, the water passing hole is at least partially opened and accessible, and when the auxiliary lid body rotates to a position where the water passing port does not align with the water passing hole, the water passing hole is closed by the auxiliary lid body; the auxiliary lid body also comprises an air guide slot which the air vent is slidable therein as the auxiliary lid body rotates; the air guide slot is in communication to an external environment.

The air guide slot is provided with a communicating slot through which the air guide slot is in communication to an outer circumferential surface of the auxiliary lid body; the communicating slot is further recessed from a bottom surface of the air guide slot; when the auxiliary lid body is rotated to a position where the water passing port completely aligns with the water passing hole, the air vent is located to align and to be in communication with the communicating slot.

Preferably, the water passing hole and the air vent are located at two ends of a same diameter of the main lid body respectively, and the communicating slot and the water passing port are located at two ends of a same diameter of the auxiliary lid body respectively.

Preferably, the upper surface of the main lid body is recessed to form a recess which is circular in shape; further, a bottom surface of the recess is an inclined plane inclined with respect to a horizontal plane perpendicular to an axis of the main lid body; the water passing hole is arranged at a lowest position of the inclined plane of the recess, and the air vent is arranged at a highest position of the inclined plane of the recess.

Preferably, a portion of a side wall of the recess corresponding to the water passing hole is recessed to form a water pouring groove.

A post is provided on an inner bottom surface of the recess; a circumferential surface of the post is provided with at least one limiting flange extending along a circumferential direction of the post; the auxiliary lid body is provided with a through hole which sleeves the post; a side wall of the through hole is provided with a limiting groove to slidably receive said at least one limiting flange of the post; at least one cutaway portion is formed at a lower side edge of the through hole to allow said at least one limiting flange to enter said limiting groove; said at least one limiting flange enters said limiting groove from said at least one cutaway portion, and said at least one limiting flange is slidably received within said limiting groove to achieve rotation of the auxiliary lid body with respect to the main lid body.

Preferably, said at least one limiting flange comprises two limiting flanges symmetrically arranged on two sides of the post; correspondingly, said at least one cutaway portion comprises two cutaway portions.

Preferably, a side wall of the air guide slot is provided with at least one limiting portion which protrudes out of the side wall of the air guide slot to limit sliding of the air vent in the air guide slot, to limit a rotational angle of the auxiliary lid body, and to prevent the auxiliary lid body from being rotated to a position where said at least one limiting flange corresponds to said at least one cutaway portion.

Preferably, said at least one limiting portion is an elastic piece disposed on the side wall of the air guide slot; said at least one limiting portion comprises two limiting portions disposed on two opposite positions of the side wall of the air guide slot.

Preferably, the two limiting portions are positioned between two ends of the air guide slot; when the auxiliary lid body is rotated such that the air vent slides between one end of the air guide slot and said at least one limiting portion, the auxiliary lid body is rotated between a closed state and an opened state of the water passing hole; when the auxiliary lid body is rotated such that the air vent slides passed said at least one limiting portion to another end of the air guide slot, the auxiliary lid body is rotated to a position where said at least one limiting flange corresponds to said at least one cutaway portion.

Preferably, the post is made of transparent material.

Preferably, an operating handle is provided on an upper surface of the auxiliary lid body.

An outer circumferential surface of the main lid body is provided with a mounting groove; a sealing ring is disposed in the mounting groove; a bottom surface of the auxiliary lid body is provided with a sealing gasket; the sealing gasket is removably sealed with the water passing hole of the main lid body.

A grip is arranged on the outer circumferential surface of the main lid body; the grip is positioned opposite to the water passing hole; a clasping portion is arranged on a side wall of the water passing port.

According to another aspect of the present invention, a container comprising the cup lid described above is provided.

After adopting the above technical solutions, the present invention has the following technical effects:

1) The auxiliary lid body is rotatable with respect to the main lid body so that the water passing hole is at least partially opened when the auxiliary lid body rotates to a position where the water passing port at least partially aligns with the water passing hole, and the water passing hole is closed when the auxiliary lid body rotates to a position where the water passing port does not align with the water passing hole. Also, due to the air vent of the main lid body and the air guide slot of the auxiliary lid body which the air vent is slidable therein as the auxiliary lid body rotates, and because the air guide slot is in communication with the external environment, the air vent is always in communication with the external environment, and therefore air pressure in and out of the container is always balanced, thereby easing the rotation of the auxiliary lid body so that the auxiliary lid body can be rotated without the need of much effort, and rotation can be easily achieved by one hand. Further, configurations of the air vent and the air guide slot may also limit an angle of rotation of the auxiliary lid body, specifically, when the auxiliary lid body rotates, a maximal angle of rotation of the auxiliary lid body corresponds to a length of the air guide slot which the air vent slides from one end of the air guide slot to another end of the air guide slot, so that excessive rotation is prevented, thereby enhancing the user's experience.

2) The cup lid of the present invention does not require complete sealing between the cup lid and the container, and a small diameter water passing hole which can be quickly and conveniently opened and closed is provided. Hence, the cup lid of the present invention is particularly suitable for use for example, as a car cup, wherein user's operation is more convenient and the risk of safety hazards is reduced.

DETAILED DESCRIPTION OF THE INVENTION

Figure 1:
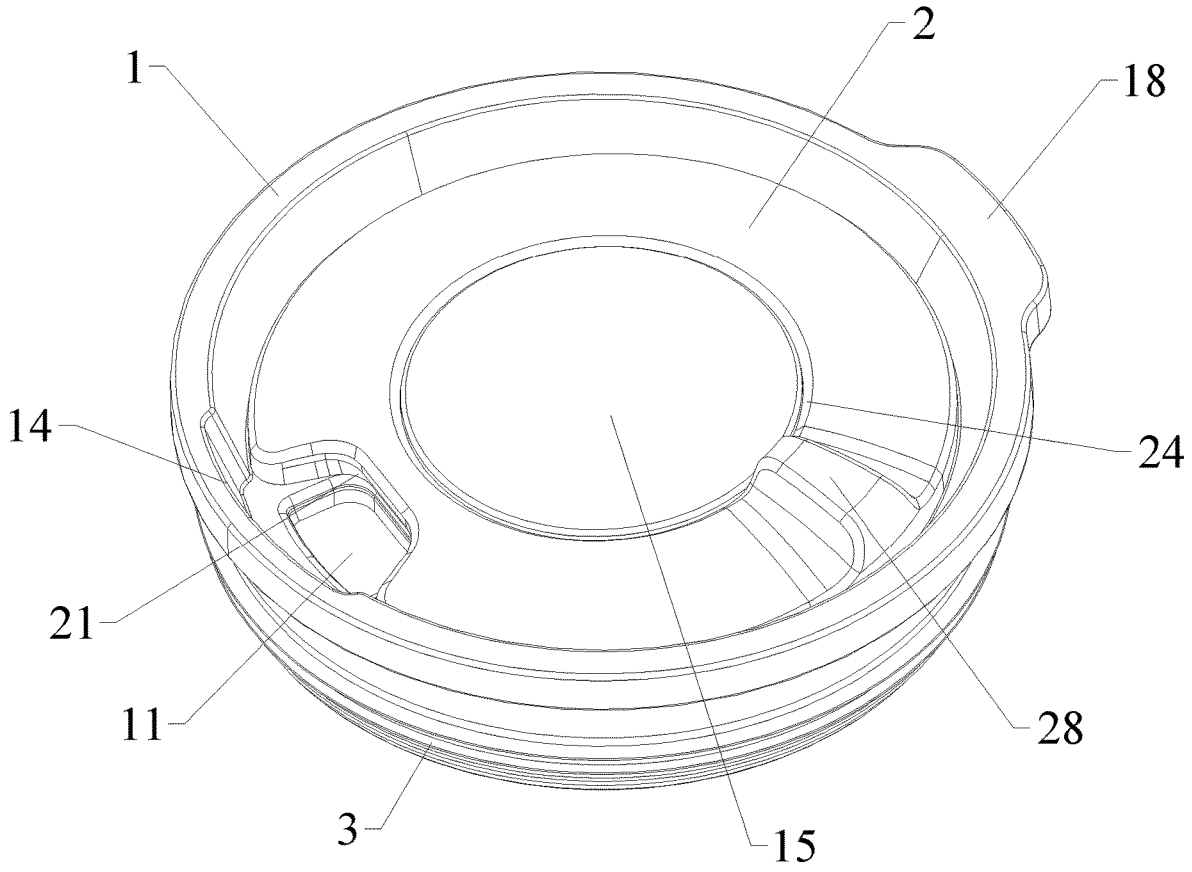
FIG. 1 is a perspective view of a cup lid according to an embodiment of the present invention in a completely opened state.
Figure 2:
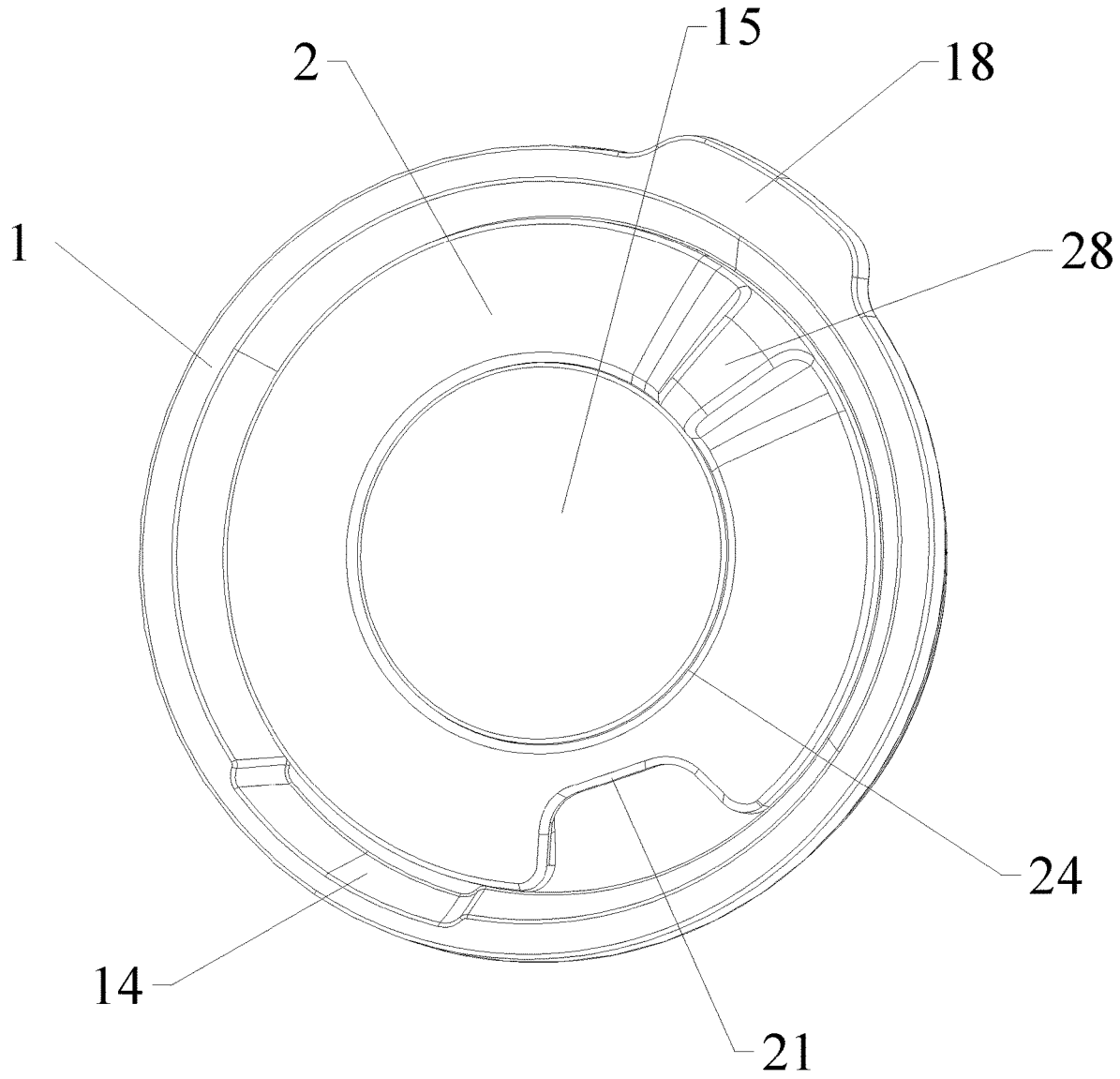
FIG. 2 is a perspective view of the cup lid according to an embodiment of the present invention in a completely closed state.
Figure 3:
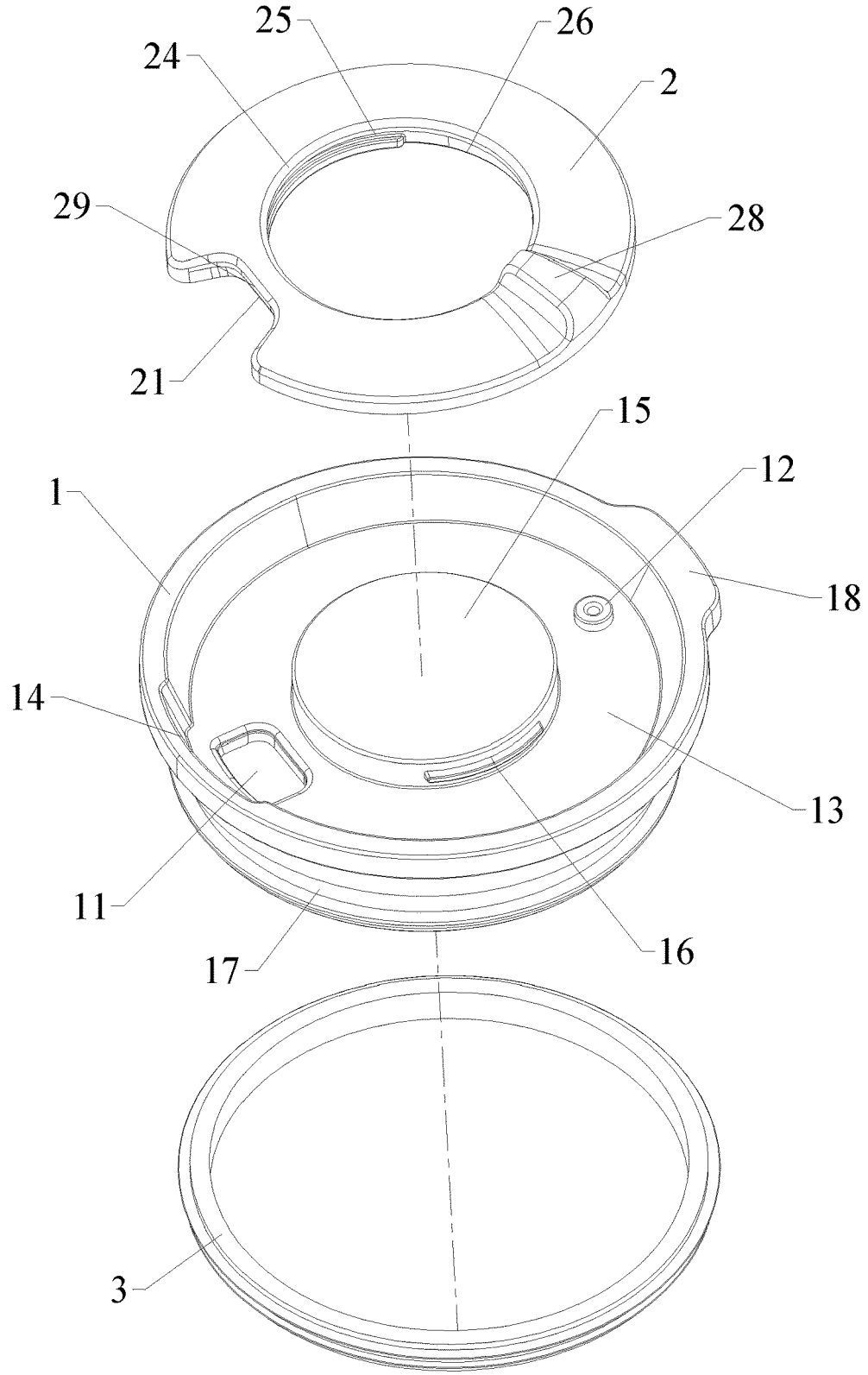
FIG. 3 is a first exploded view of the cup lid according to an embodiment of the present invention.
Figure 4:
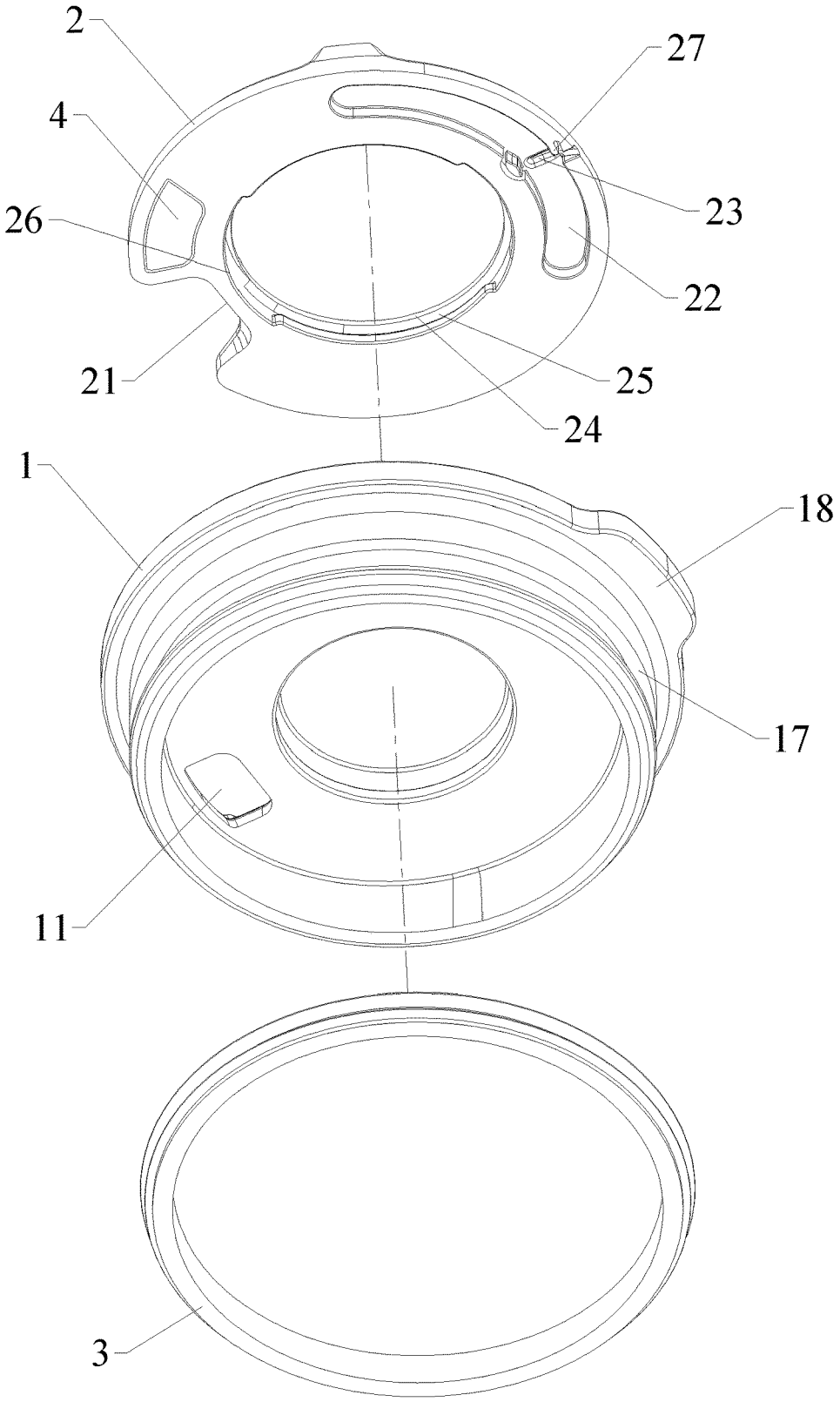
FIG. 4 is a second exploded view of the cup lid according to an embodiment of the present invention.
Figure 5:
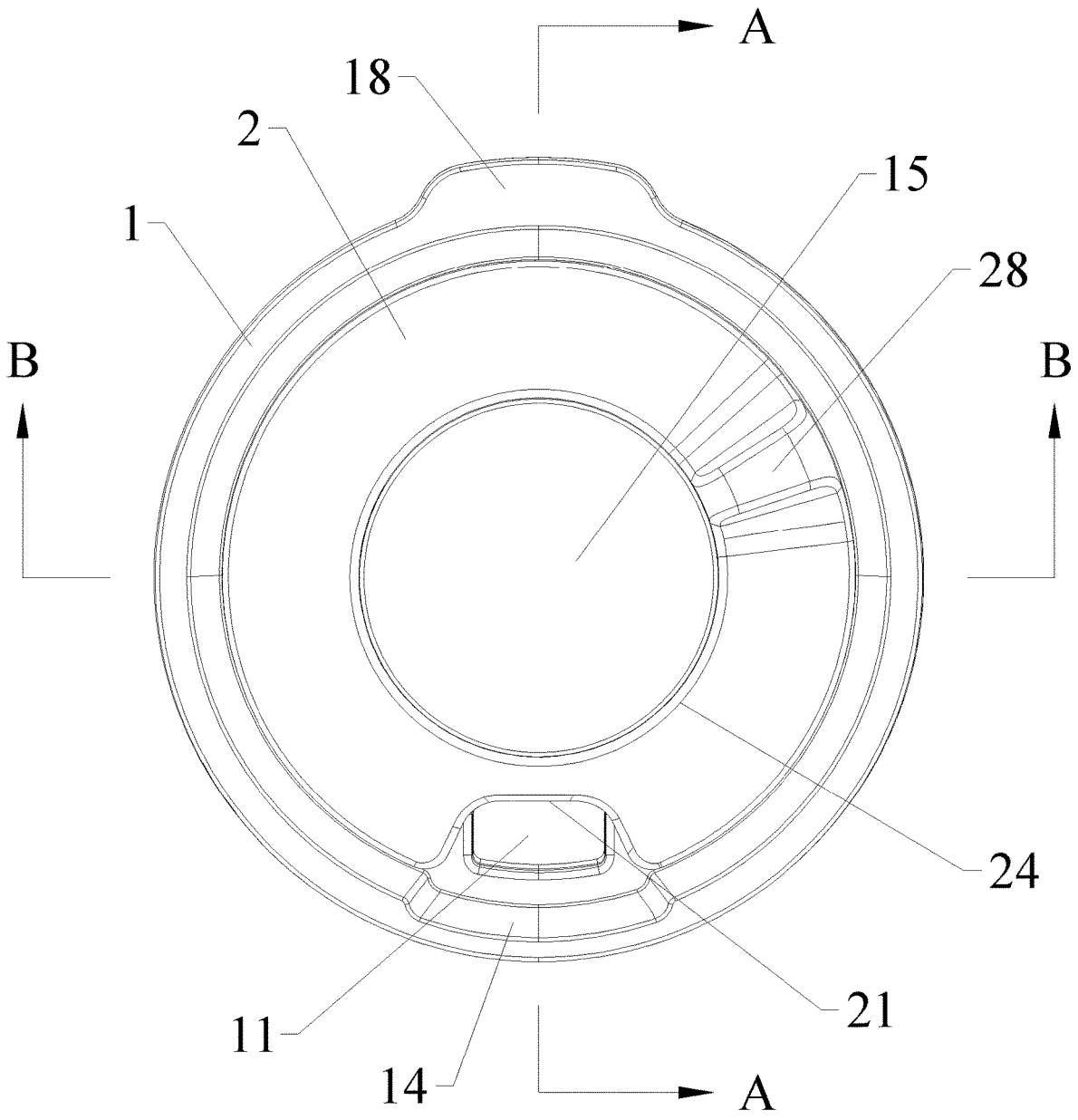
FIG. 5 is a top plan view of the cup lid according to an embodiment of the present invention in a completely opened state.
Figure 6:
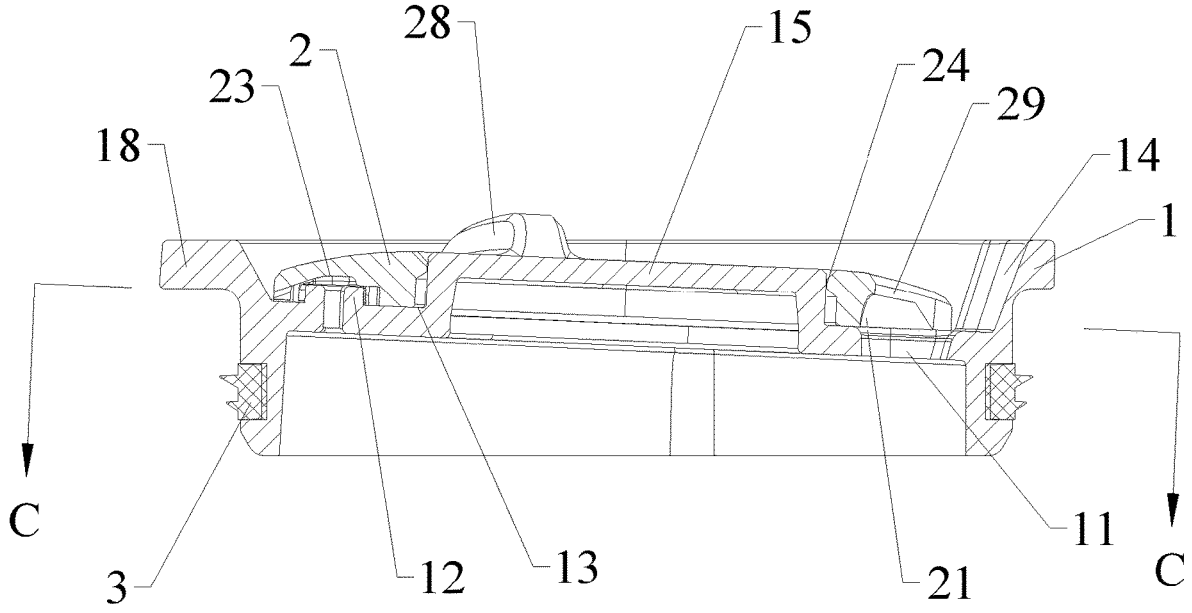
FIG. 6 is a sectional view along line A-A of FIG. 5.
Figure 7:
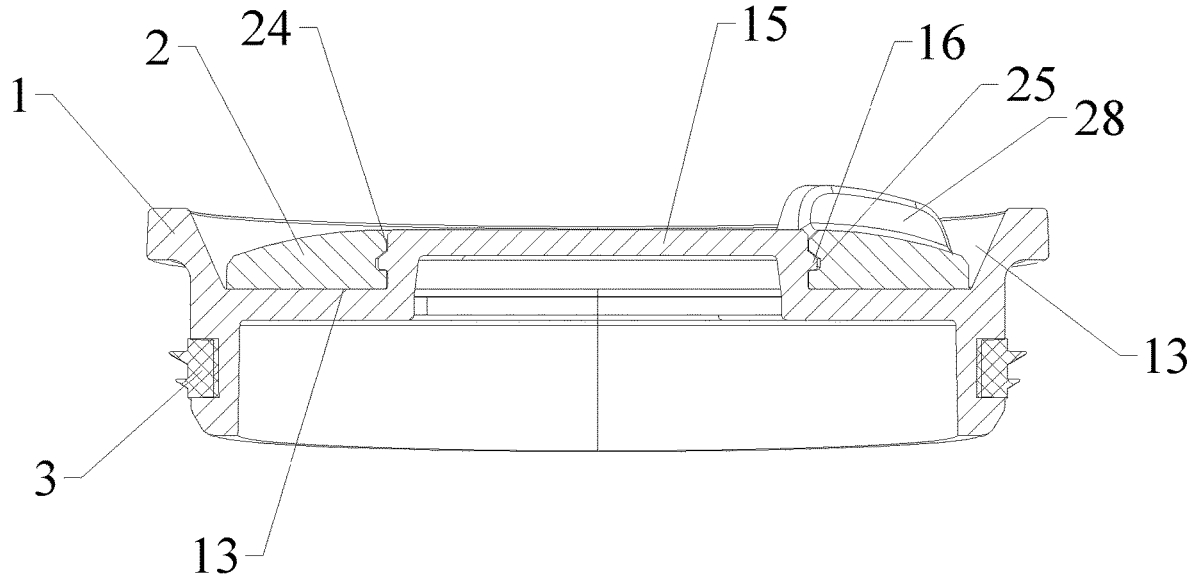
FIG. 7 is a sectional view along line B-B of FIG. 5.
Figure 8:
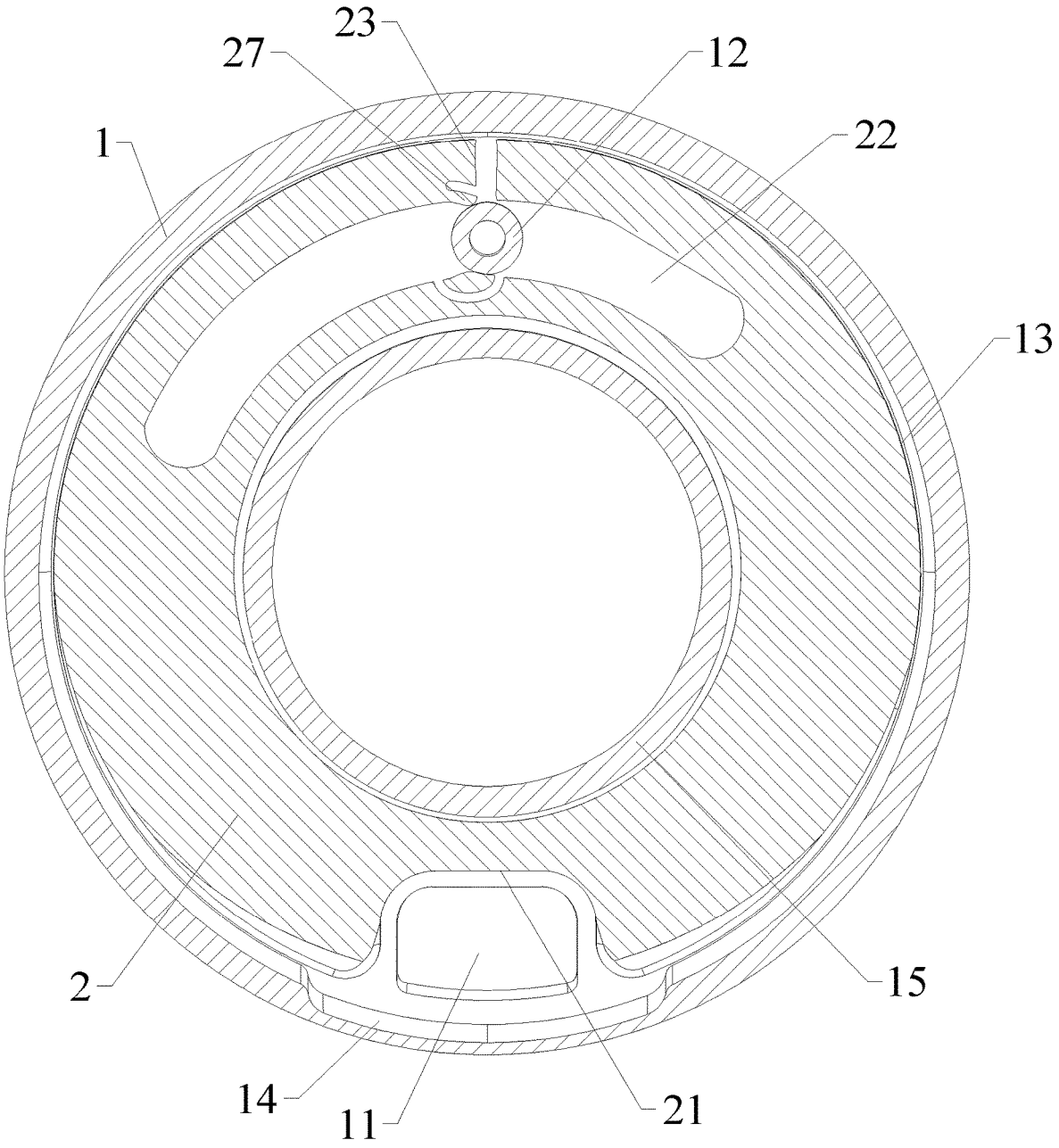
FIG. 8 is a sectional view along line C-C of FIG. 6.
Figure 9:
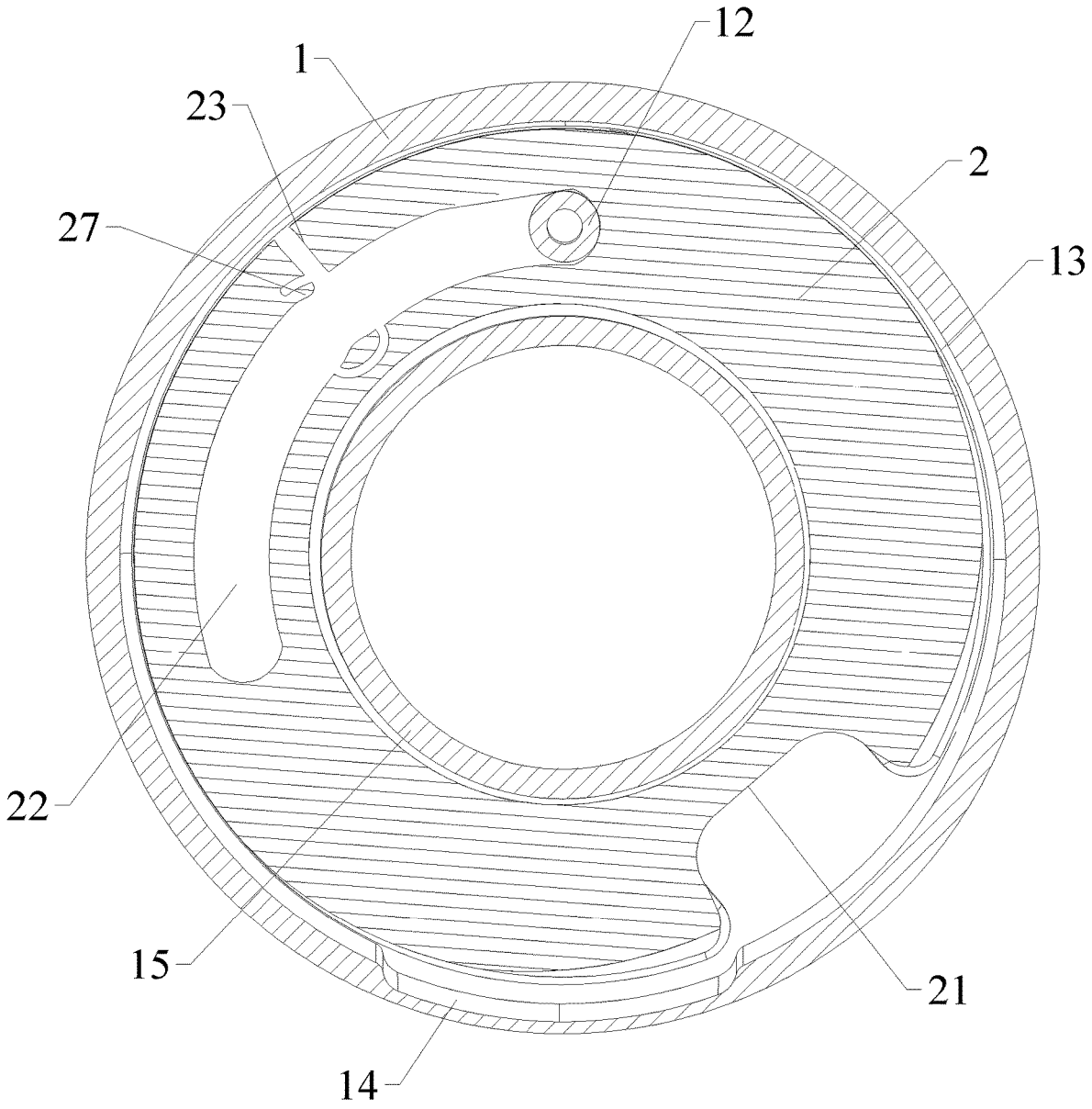
FIG. 9 is a sectional view of the cup lid according to an embodiment of the present invention in a completely closed state.
Figure 10:
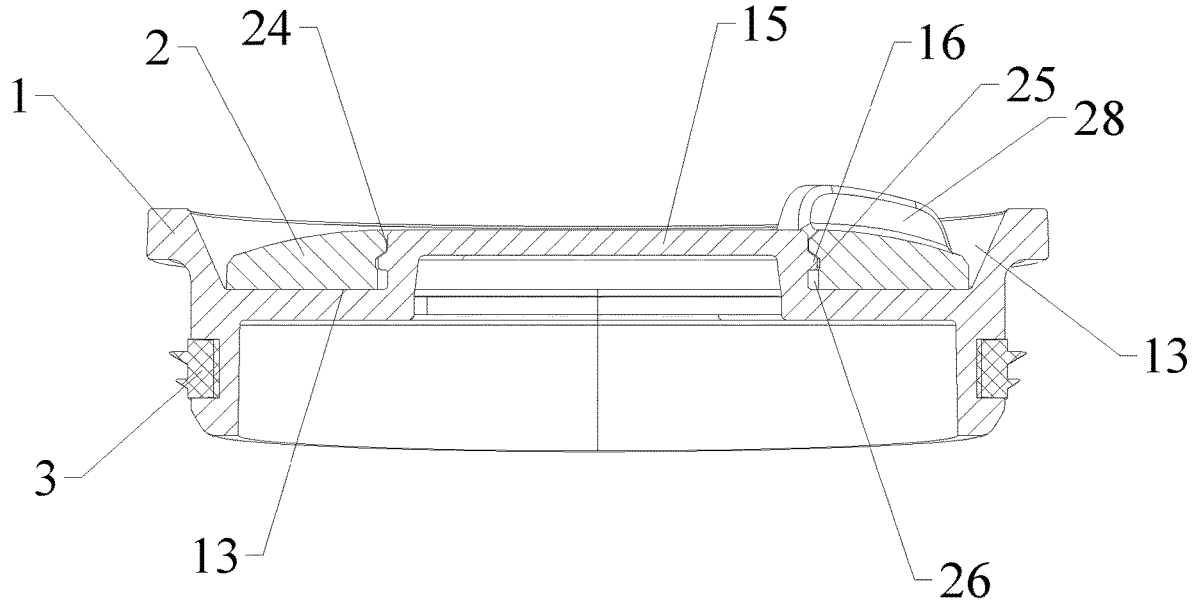
FIG. 10 is a first sectional view of the cup lid when the auxiliary lid body is rotated to a position where the limiting flange corresponds to the cutaway portion.
Figure 11:
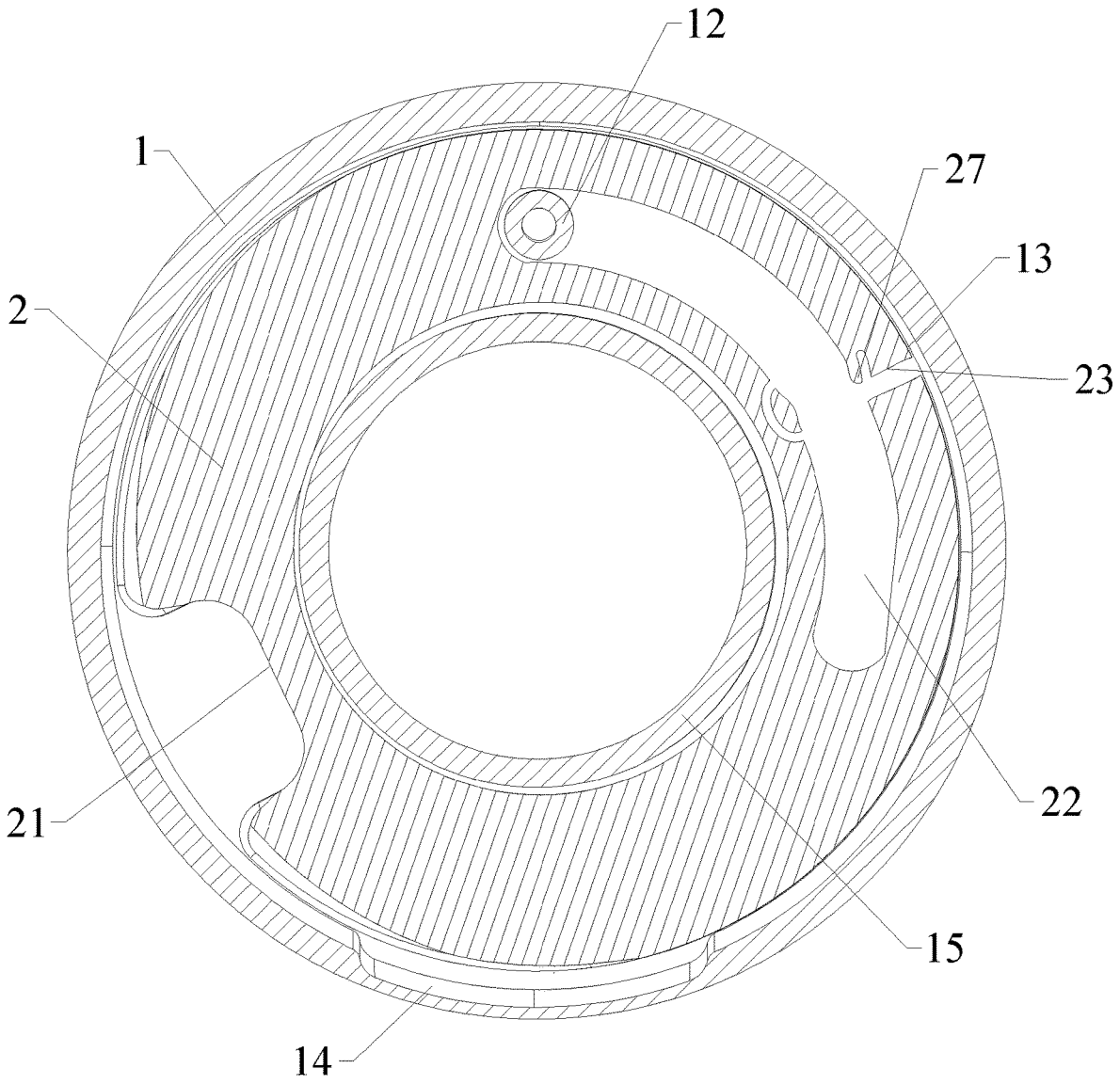
FIG. 11 is a second sectional view of the cup lid when the auxiliary lid body is rotated to a position where the limiting flange corresponds to the cutaway portion.

Referring to FIGS. 1 to 11, the present invention discloses a cup lid, comprising a main lid body 1 and an auxiliary lid body 2.

The main lid body 1 is configured to removably seal an opening 51 of a container 5, and an upper surface of the main lid body 1 is provided with a water passing hole 11 and an air vent 12.

The auxiliary lid body 2 is rotatably disposed on the upper surface of the main lid body 1 and being axially limited with the main lid body 1 to prevent the auxiliary lid body 2 from falling off from the main lid body 1. The auxiliary lid body 2 is provided with a water passing port 21; when the auxiliary lid body 2 rotates to a position where the water passing port 21 aligns with the water passing hole 11, the water passing hole 11 is opened and accessible, and when the auxiliary lid body 2 rotates to a position where the water passing port 21 does not align with the water passing hole 11, the water passing hole 11 is closed by the auxiliary lid body 2; the auxiliary lid body 2 also comprises an air guide slot 22 which the air vent 12 is slidable therein as the auxiliary lid body 2 rotates; the air guide slot 22 is in communication to an external environment.

According to the technical solutions provided above, the auxiliary lid body 2 is rotatable with respect to the main lid body 1 so that the water passing hole 11 is at least partially opened when the auxiliary lid body 2 rotates to a position where the water passing port 21 at least partially aligns with the water passing hole 11, and the water passing hole 11 is closed when the auxiliary lid body rotates to a position where the water passing port 21 does not align with the water passing hole 11. Also, due to the air vent 12 of the main lid body 1 and the air guide slot 22 of the auxiliary lid body 2 which the air vent 12 is slidable therein as the auxiliary lid body rotates, and because the air guide slot 22 is in communication with the external environment, the air vent 12 is always in communication with the external environment, and therefore air pressure in and out of the container 5 is always balanced, thereby easing the rotation of the auxiliary lid body 2 so that the auxiliary lid body 2 can be rotated without the need of much effort, and rotation can be easily achieved by one hand. Further, configurations of the air vent 12 and the air guide slot 22 may also limit an angle of rotation of the auxiliary lid body 2, specifically, when the auxiliary lid body 2 rotates, a maximal angle of rotation of the auxiliary lid body 2 corresponds to a length of the air guide slot 22 which the air vent 12 slides from one end of the air guide slot 22 to another end of the air guide slot 22, so that excessive rotation is prevented, thereby enhancing the user's experience. The cup lid of the present invention does not require complete sealing between the cup lid and the container, and a small diameter water passing hole 11 which can be quickly and conveniently opened and closed is provided. Hence, the cup lid of the present invention is particularly suitable for use for example, as a car cup, wherein user's operation is more convenient and the risk of safety hazards is reduced.

Some embodiments of the present invention are described below.

The air guide slot 22 is provided with a communicating slot 23 through which the air guide slot 22 is in communication to an outer circumferential surface of the auxiliary lid body 2. The communicating slot 23 is further recessed from a bottom surface of the air guide slot 22 so that the communicating slot 23 is stepped with respect to the air guide slot 22; when the auxiliary lid body 2 is rotated to a position where the water passing port 21 aligns with the water passing hole 11, the air vent 12 is located to align and to be in communication with the communicating slot 23; accordingly, when the auxiliary lid body 2 is rotated to a position where the water passing port 21 aligns with the water passing hole 11, the air vent 12 is maximally ventilated with the external environment because it is aligned with the communicating slot 23, and a difference in air pressure in and out of the container 5 can be quickly balanced, so that water can smoothly flow out from the water passing hole 11, avoiding discontinuous and sporadic outflow of water through the water passing hole 11 which is relatively small in size, thereby improving the user's experience. Moreover, when the water passing hole 11 is closed, the air vent 12 is located in the air guide slot 22 and is far away from the communicating slot 23, and two sides of the air vent 12 are enclosed within the air guide slot 22, so that water leakage is greatly reduced.

Further, the water passing hole 11 and the air vent 12 are located at two ends of a same diameter of the main lid body 1 respectively, and the communicating slot 23 and the water passing port 21 are located at two ends of a same diameter of the auxiliary lid body 2 respectively, so that the cup lid design is facilitated and be more aesthetically appealing, also, the problem of product tolerance where the air vent 12 may not be aligned with the communicating slot 23 when the water passing hole 11 is aligned with the water passing port 21 can be avoided as much as possible.

However, as the air vent 12 is always in communication to the external environment through the air guide slot 22 and the communicating slot 23, when the container 5 is placed in an environment, such as in an automobile, which is unsteady, a small amount of water may be inevitably splashed out from the air vent 12 and the water may possibly flow to the upper surface of the main lid body 1 through the communicating slot 23. In view of this problem, the upper surface of the main lid body 1 is recessed to form a recess 13 which is circular in shape; further, a bottom surface of the recess 13 is an inclined plane inclined with respect to a horizontal plane perpendicular to an axis of the main lid body 1. Furthermore, the water passing hole 11 is arranged at the lowest position of the inclined plane of the recess 13, and the air vent 12 is arranged at the highest position of the inclined plane of the recess 13. Accordingly, even if a small amount of water is splashed out/overflows, the water will not be splashed out to the external environment due to the blocking effect of the side wall of the recess 13; the splashed out water will instead return into the air guide slot 22, or flow along the inclined plane of the recess 13 and back into the container 5 through the water passing hole 11.

Further, a portion of the side wall of the recess 13 corresponding to the water passing hole 11 is recessed to form a water pouring groove 14; the water pouring groove 14 cuts into said portion of the side wall of the recess 13 and inclines outwardly along a direction from the water passing hole 11 to an upper side edge of the recess 13 of the main lid body 1, so that when water is poured out from the water passing hole 11, the water will be gathered in the water pouring groove 14 and flow outwardly from the main lid body 1 to provide better water drinking experience to the users.

A post 15 is provided on an inner bottom surface of the recess 13; a circumferential surface of the post 15 is provided with at least one limiting flange 16 extending along a circumferential direction of the post 15; the auxiliary lid body 2 has a ring shape provided with a through hole 24 which sleeves the post 15; a side wall of the through hole 24 is provided with a limiting groove 25 to slidably receive said at least one limiting flange 16 of the post 15; at least one cutaway portion 26 is formed at a lower side edge of the through hole 24 to allow said at least one limiting flange 16 to enter said limiting groove 25; said at least one limiting flange 16 enters said limiting groove 25 from said at least one cutaway portion 26, and said at least one limiting flange 16 is slidably received within said limiting groove 25 to achieve rotation of the auxiliary lid body 2 with respect to the main lid body 1; as mentioned above, rotation of the auxiliary lid body 2 will cause the water passing port 21 to be at least partially aligned with the water passing hole 11 or misaligned with the water passing hole 11, so that opening and closing of the water passing hole 11 and an amount of water flowing out from the water passing hole 11 can be adjusted. Rotation of the auxiliary lid body 2 with respect to the main lid body 1 is achieved through the post 15 of the main lid body 1 and the through hole 24 of the auxiliary lid body 2, and so no other holes part from the water passing hole 11 and the air vent 12 are required to be formed on the main lid body 1, thereby reducing the risk of water leakage during use. Besides, said at least one limiting flange 16 slidably received in said limiting groove 25 can prevent the auxiliary lid body 2 from falling off from the main lid body 1. In this embodiment, the post 15 is formed on an axis of the recess 13; said at least one limiting flange 16 comprises two limiting flanges 16 symmetrically arranged on two sides of the post 15; correspondingly, said at least one cutaway portion 26 comprises two cutaway portions 26. Since the two limiting flanges 16 are slidably received in the limiting groove 25, the auxiliary lid body 2 receives even operational force around its circumference such that its structure is more stable and will not be easily tilted to one side during use.

Further, a side wall of the air guide slot 22 is provided with at least one limiting portion 27 which protrudes out of the side wall of the air guide slot 22 to limit sliding of the air vent 12 in the air guide slot 22, to limit a rotational angle of the auxiliary lid body 2, and to prevent the auxiliary lid body 2 from being rotated to a position where said at least one limiting flange 16 corresponds to said at least one cutaway portion 26. Due to said at least one limiting portion 27, when the auxiliary lid body 2 is assembled to the main lid body 1 during normal use of the cup lid, user is prevented from rotating the auxiliary lid body 2 to the position where said at least one limiting flange 16 corresponds to said at least one cutaway portion 26; when the auxiliary lid body 2 rotates, the air vent 12 is slidable in the air guide slot 22 between one end of the guiding slot 22 and said at least one limiting portion 27 to correspond to a fully closed state of the water passing hole 11 and a fully opened state of the water passing hole 11 respectively. When it is required to disassemble the auxiliary lid body 2 from the main lid body 1, apply a larger rotational force to the auxiliary lid body 2 to overcome the limiting effect of said at least one limiting portion 27 so that the air vent 12 slides passed said at least one limiting portion 27 to another end of the guiding slot 22 where said at least one limiting flange 16 corresponds to said at least one cutaway portion 26, and hence the auxiliary lid body 2 can be disassembled. In this embodiment, with reference to FIG. 8, said at least one limiting portion 27 is an elastic piece disposed on the side wall of the air guide slot 22; elasticity of the elastic piece can facilitate user to disassemble the auxiliary lid body 2 with less effort needed. Further, said at least one limiting portion 27 may comprise two limiting portions 27 disposed on two opposite positions of the side wall of the air guide slot 22 to achieve even better limiting effect. Further, the two limiting portions 27 are positioned corresponding to one and a same side of the communicating slot 23, and the two limiting portions 27 are positioned between two ends of the air guide slot 22. With reference to FIGS. 1, 2, 8, and 9, when the auxiliary lid body 2 is rotated such that the air vent 12 slides between one end of the air guide slot 22 and said at least one limiting portion 27, the auxiliary lid body 2 is rotated between a closed state and an opened state of the water passing hole 11; with reference to FIGS. 10 and 11, when the auxiliary lid body 2 is rotated such that the air vent 12 slides passed said at least one limiting portion 27 to another end of the air guide slot 22, the auxiliary lid body 2 is rotated to a position where said at least one limiting flange 16 corresponds to said at least one cutaway portion 26 to allow the auxiliary lid body 2 to be disassembled. A portion of the air guide slot 22 from said at least one limiting portion 27 to said another end of the air guide slot 22 provides space and allows continuous guiding function for the air vent 12 to slide in the air guide slot 22 from said at least one limiting portion 27 to said another end of the air guide slot 22 as the auxiliary lid body 2 rotates, and also prevents unsteadiness during disassembly of the auxiliary lid body 2 which may otherwise cause water to splash out.

Further, the air guide slot 22 has an arc shape which shares a same center of circle with the post 15; when the auxiliary lid body 2 rotates, the air vent 12 will slide in the air guide slot 22.

Further, the post 15 is made of transparent material so that an interior of the container 5 can be observed.

An operating handle 28 is provided on an upper surface of the auxiliary lid body 2 to facilitate rotational operation of the auxiliary lid body 2 by a user.

An outer circumferential surface of the main lid body 1 is provided with a mounting groove 17; a sealing ring 3 is disposed in the mounting groove 17; the sealing ring disposed in the mounting groove 17 is adaptable to be removably sealed with an opening 51 of a container 5.

Further, a grip 18 is arranged on the outer circumferential surface of the main lid body 1 to provide a place where user can apply a force to force apart the main lid body 1 from the container 5, thereby quickly opening the main lid body 1. In this embodiment, the grip 18 is positioned opposite to the water passing hole 11.

Alternatively, external threads may be arranged on the outer circumferential surface of the main lid body 1, and the external threads are in threaded connection with internal threads at the opening 51 of the container 5 so as to achieve removable sealing effect.

In an embodiment of the present invention, a clasping portion 29 is arranged on a side wall of the water passing port 21, and the clasping portion 29 is an inclined surface or a curved surface recessed from the side wall of the water passing port 21. The clasping portion 29 facilitates the auxiliary lid body 2 to be taken out.

A bottom surface of the auxiliary lid body 2 is provided with a sealing gasket 4; the sealing gasket 4 is removably sealed with the water passing hole 11 of the main lid body 1.

Figure 12:
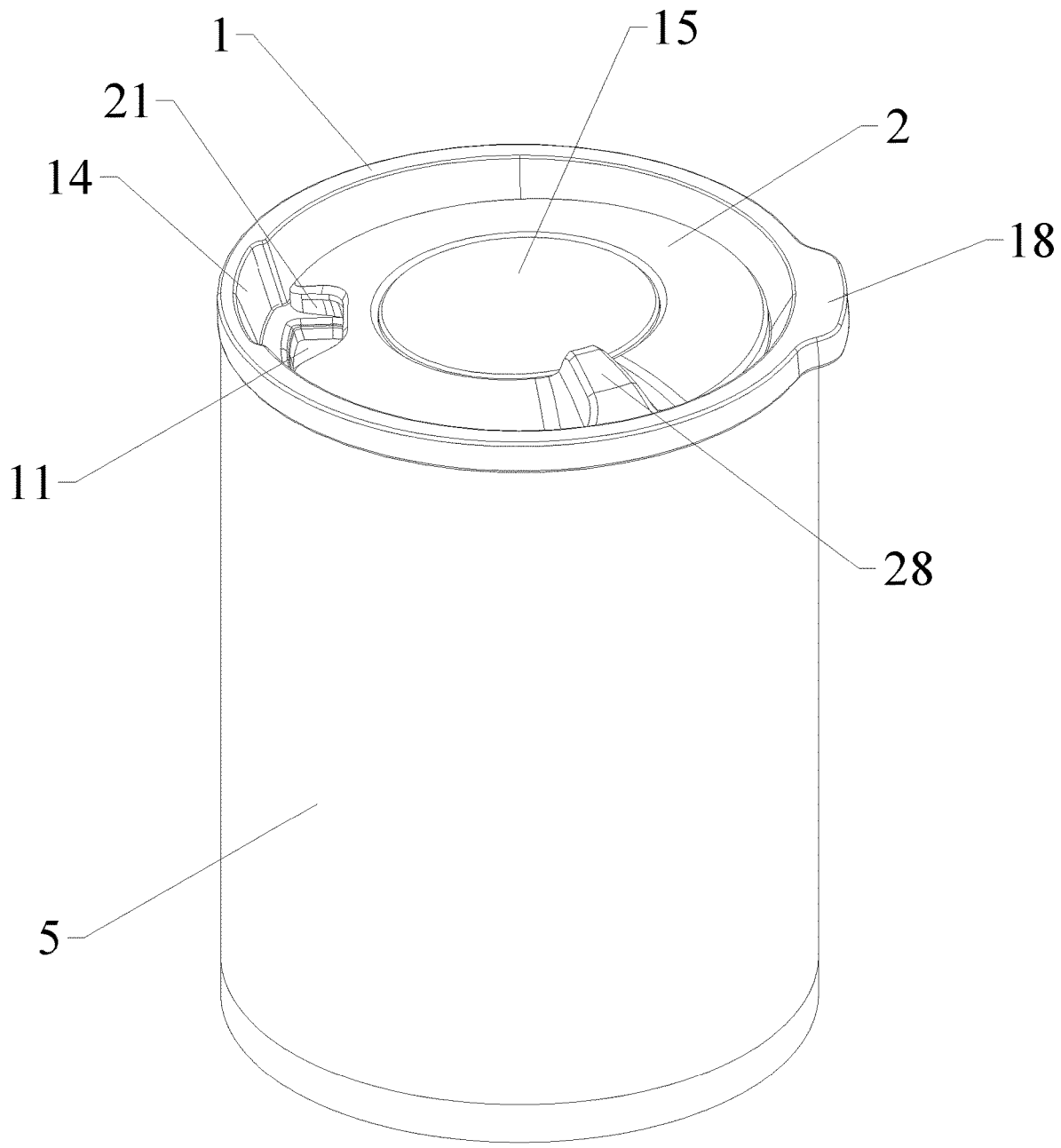
FIG. 12 is a schematic illustration of a container using the cup lid according to the present invention.
Figure 13:
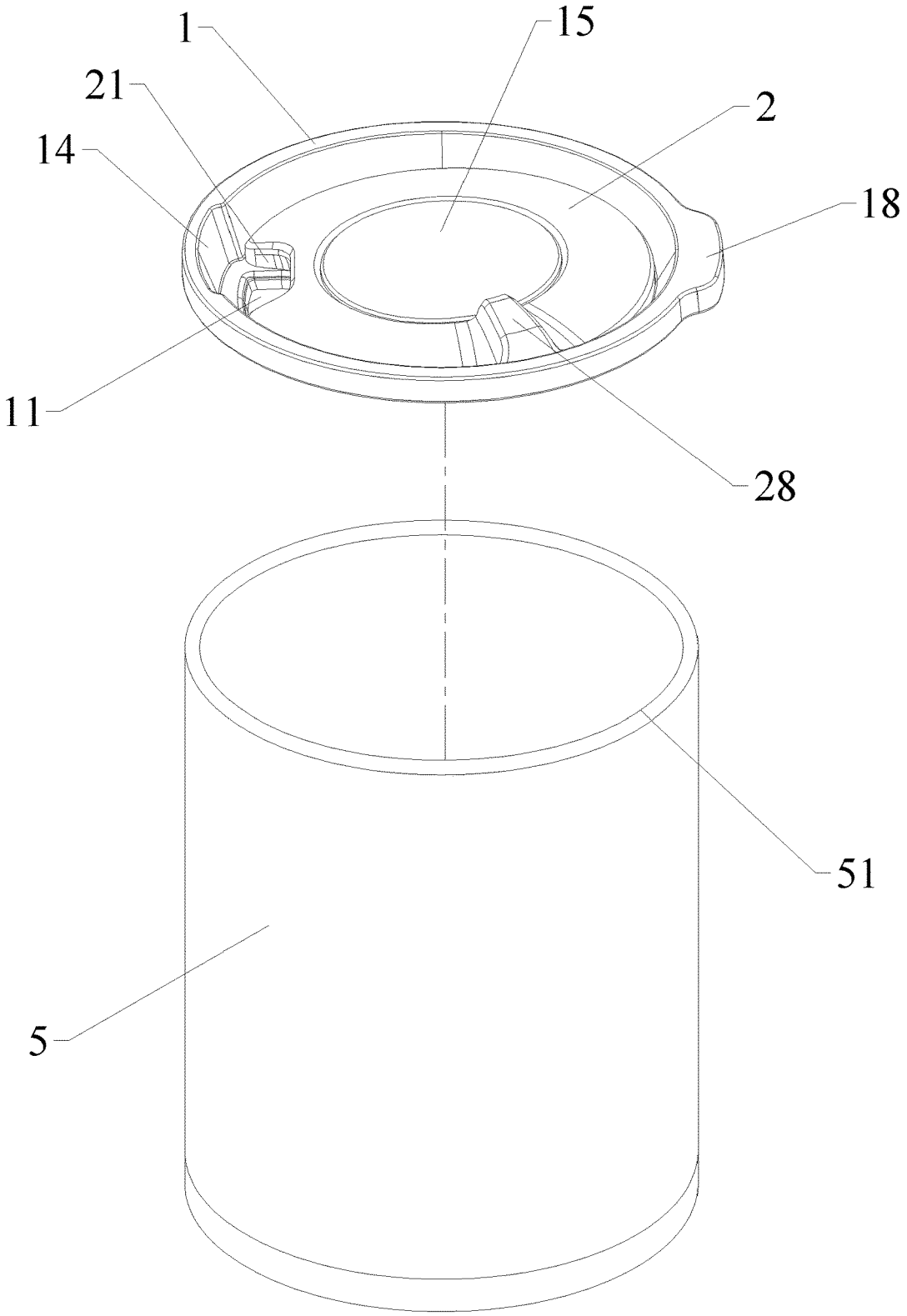
FIG. 13 is an exploded view of FIG. 12.

With reference to FIG. 12 and FIG. 13, the cup lid may be applied to a container 5 including, but not limited to, a stainless steel cup, an enamel cup, and a glass cup, which can be used for holding water.

What is claimed is:

1. A cup lid, comprising:

a main lid body and an auxiliary lid body;

the main lid body is configured to removably seal an opening of a container; an upper surface of the main lid body is provided with a water passing hole and an air vent;

the auxiliary lid body is rotatably disposed on the upper surface of the main lid body and being axially limited with respect to the main lid body; the auxiliary lid body is provided with a water passing port; when the auxiliary lid body rotates to a position where the water passing port at least partially aligns with the water passing hole, the water passing hole is at least partially opened and accessible, and when the auxiliary lid body rotates to a position where the water passing port does not align with the water passing hole, the water passing hole is closed by the auxiliary lid body; the auxiliary lid body also comprises an air guide slot which the air vent is slidable therein as the auxiliary lid body rotates; the air guide slot is in communication to an external environment;

the air guide slot is provided with a communicating slot through which the air guide slot is in communication to an outer circumferential surface of the auxiliary lid body; the communicating slot is further recessed from a bottom surface of the air guide slot; when the auxiliary lid body is rotated to a position where the water passing port completely aligns with the water passing hole, the air vent is located to align and to be in communication with the communicating slot;

the water passing hole and the air vent are located at two ends of a same diameter of the main lid body respectively, and the communicating slot and the water passing port are located at two ends of a same diameter of the auxiliary lid body respectively;

the upper surface of the main lid body is recessed to form a recess which is circular in shape; further, a bottom surface of the recess is an inclined plane inclined with respect to a horizontal plane perpendicular to an axis of the main lid body; the water passing hole is arranged at a lowest position of the inclined plane of the recess, and the air vent is arranged at a highest position of the inclined plane of the recess.

2. The cup lid of claim 1, wherein a portion of a side wall of the recess corresponding to the water passing hole is recessed to form a water pouring groove.

3. The cup lid of claim 1, wherein a post is provided on an inner bottom surface of the recess; a circumferential surface of the post is provided with at least one limiting flange extending along a circumferential direction of the post; the auxiliary lid body is provided with a through hole which sleeves the post; a side wall of the through hole is provided with a limiting groove to slidably receive said at least one limiting flange of the post; at least one cutaway portion is formed at a lower side edge of the through hole to allow said at least one limiting flange to enter said limiting groove; said at least one limiting flange enters said limiting groove from said at least one cutaway portion, and said at least one limiting flange is slidably received within said limiting groove to achieve rotation of the auxiliary lid body with respect to the main lid body.

4. The cup lid of claim 3, wherein said at least one limiting flange comprises two limiting flanges symmetrically arranged on two sides of the post; correspondingly, said at least one cutaway portion comprises two cutaway portions.

5. The cup lid of claim 3, wherein a side wall of the air guide slot is provided with at least one limiting portion which protrudes out of the side wall of the air guide slot to define a first rotational angle of the auxiliary lid body and a corresponding first stroke of the air vent sliding in the air guide slot to achieve opening and closing of the water passing hole, and to prevent the auxiliary lid body from being rotated past said at least one limiting portion to a position where said at least one limiting flange corresponds to said at least one cutaway portion if a force that overcomes a limiting effect of said at least one limiting portion is not applied; said at least one limiting portion is an elastic piece disposed on the side wall of the air guide slot.

6. The cup lid of claim 5, wherein said at least one limiting portions are positioned between two ends of the air guide slot; when the auxiliary lid body is rotated by said first rotational angle such that the air vent slides according to said corresponding first stroke between one end of the air guide slot and said at least one limiting portion, the auxiliary lid body is rotated between a closed state and an opened state of the water passing hole; when the auxiliary lid body is rotated with a force that overcomes the limiting effect of said at least one limiting portion such that the auxiliary lid body is rotated by a second rotational angle according to which the air vent slides according to a corresponding second stroke that past said at least one limiting portion to another end of the air guide slot, the auxiliary lid body is rotated to a position where said at least one limiting flange corresponds to said at least one cutaway portion.

7. The cup lid of claim 3, wherein the post is made of transparent material.

8. The cup lid of claim 1, wherein an operating handle is provided on an upper surface of the auxiliary lid body.

9. The cup lid of claim 1, wherein an outer circumferential surface of the main lid body is provided with a mounting groove; a sealing ring is disposed in the mounting groove; a bottom surface of the auxiliary lid body is provided with a sealing gasket.

10. The cup lid of claim 1, wherein a grip is arranged on an outer circumferential surface of the main lid body; the grip is positioned opposite to the water passing hole; a clasping portion is arranged on a side wall of the water passing port.

11. A container, comprising the cup lid of claim 1.

* * * * *